US007814689B2

(12) United States Patent
Vering et al.

(10) Patent No.: US 7,814,689 B2
(45) Date of Patent: Oct. 19, 2010

(54) QUICK COUPLER

(75) Inventors: Andrew Lee Vering, Manhattan, KS (US); Karl E. Lindenmuth, Wamego, KS (US); Richard Kent Oswald, Onaga, KS (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 11/738,353

(22) Filed: Apr. 20, 2007

(65) Prior Publication Data

US 2007/0245603 A1 Oct. 25, 2007

Related U.S. Application Data

(60) Provisional application No. 60/745,270, filed on Apr. 20, 2006.

(51) Int. Cl.
*E02F 3/96* (2006.01)
*B66C 23/00* (2006.01)

(52) U.S. Cl. ..... 37/468; 414/723

(58) Field of Classification Search ..... 37/234, 37/413, 468; 414/723, 687, 695.5–695.8, 414/694, 686; 403/321, 322.1, 322.3, 322.4, 403/324, 325; 172/272–275
See application file for complete search history.

(56) References Cited

U.S. PATENT DOCUMENTS 3,760,883 A * 9/1973 Birk ..... 172/273
3,818,551 A * 6/1974 Coughran, Jr. ..... 403/24
4,243,356 A * 1/1981 Takojima ..... 414/723
4,251,181 A * 2/1981 Drott et al. ..... 414/723
4,345,870 A * 8/1982 Anderson et al. ..... 414/686
4,674,945 A * 6/1987 Hulden ..... 414/723
4,955,779 A * 9/1990 Knackstedt ..... 414/723
5,024,010 A * 6/1991 Hulden ..... 37/417
5,107,610 A * 4/1992 Fusco ..... 37/444
5,333,695 A * 8/1994 Walter ..... 172/272
5,597,283 A * 1/1997 Jones ..... 414/723
5,692,850 A * 12/1997 Kimble et al. ..... 403/24
5,974,706 A * 11/1999 Kaczmarski et al. ..... 37/468
6,227,792 B1 * 5/2001 Baker et al. ..... 414/723

FOREIGN PATENT DOCUMENTS

DE 92 18 306 1/1994
DE 93 14 409 4/1994
EP 0 278 571 B1 10/1990
WO WO 91/18716 12/1991
WO WO 2005/093171 A1 10/2005
WO WO 2005/093172 A1 10/2005

OTHER PUBLICATIONS

PCT International Search Report; Applicant Ref. No. 05-922; International Application No. PCT/US2007/009811; Filing Date: Apr. 20, 2007; Priority Date: Apr. 20, 2006; Applicant: Caterpillar Inc.

* cited by examiner

*Primary Examiner*—Robert E Pezzuto
(74) *Attorney, Agent, or Firm*—Andrew J. Ririe

(57) ABSTRACT

A quick coupler includes mounting structure for mounting the coupler to a machine, and for mounting the coupler to an implement. The mounting structure on the coupler includes wedge coupling surfaces and a tube. The mounting structure on the implement includes hooks for engaging the tube, and complementary wedge coupling surfaces. The wedge coupling surfaces wedge together during coupling to produce and tight fit and solid hold between the coupler and implement. The mounting structure is robust, and can accommodate future possible wear. The kinematic impact on the performance of the implement due to the use of the quick coupler is minimized.

23 Claims, 12 Drawing Sheets

QUICK COUPLER

This application claims priority to U.S. provisional patent application No. 60/745,270 filed Apr. 20, 2006.

TECHNICAL FIELD

The field of this invention is quick couplers for coupling two bodies, and in particular the field is quick couplers for engaging implements, such as buckets and pallet forks, to mining and construction machinery, such as wheel loaders, track loaders, or backhoe loaders.

BACKGROUND

Mining and construction machinery includes wheel loaders, hydraulic excavators, skid steer loaders, multi-terrain loaders, track loaders, and backhoe loaders and the like. Typically implements are mounted to these machines to perform work. One example of such an implement is a bucket. A bucket could be mounted to one of these machines for performing work like digging a trench in the ground, digging material from a pile, or dozing. Another example is a pallet fork. A pallet fork could be mounted for permitting the machine to pickup and carry palletized materials around a building site or at a factory. Still another example is logging forks. Logging forks are specially adapted for picking up and carrying logs. Other non-limiting examples of implements include hammers, blades, brooms, and snow plows.

When a particular implement is attached to the machine, it enables the machine to perform a variety of tasks. In order to perform a task which the implement does not enable the machine to do, a different implement can be attached. The ability to attach multiple implements to a machine so it can perform a variety of tasks—multitasking—increases the utility and value of the machine for the owner.

On the other hand, the attaching and detaching of implements to a machine can be cumbersome and time consuming. The time spent switching implements instead of working reduces the utility of the machine.

Some implements may be mounted to a machine with a simple pin-style joint, which does not facilitate the switching of implements. With this mounting system, a pin is manually inserted into complementary bores in the machine and implement to create a pin joint. Switching implements with this system requires an operator or technician, or multiple technicians, to manually remove the pins that hold the first implement to the machine, remove the first implement, position a second implement on the machine, and manually reinsert the pins. Besides being time consuming, this switching operation can require considerable skill on the part of the operator and technicians.

Quick couplers solve many of the problems that pin-style joints present for switching implements. Quick couplers provide an alternative way to mount implements to mining and construction machinery. The quick coupler is interposed at the junction between machine and implement. The implement is attached to the quick coupler, and the quick coupler is attached to the machine. The operator of the machine commands the quick coupler to release an implement from inside the machine's cab. The machine is then repositioned to a second implement, where the operator may then manipulate the quick coupler and the machine to pickup the second implement. With a quick coupler, changing from one implement to another implement can be done quickly, and typically only requires the involvement of the machine's operator.

Many types and styles of quick couplers for mining and construction machinery have been used and proposed. One example is the coupler disclosed in EP 0 278 571 B1 (hereinafter the '571 coupler).

The '571 coupler suffers from several disadvantages. For instance, the '571 coupler may not create the most favorable wedging action between the coupler and the implement to hold the coupler tightly to the implement, even after possible future wear of the coupling surfaces. The coupling surfaces on the '571 coupler may be prone to sticking problems, making removal of the coupler from the implement difficult. In addition, the '571 coupler may be more expensive to manufacture than it need be.

SUMMARY OF THE INVENTION

A quick coupler for coupling a first body to a second body comprises attachment means for attaching the coupler to a first body, a tube adapted to be received in hooks on a second body, at least two wedges arranged for retraction and extension movement, and adapted to be extended into and retracted from wedge pockets formed on the second body, and wedge coupling surfaces adapted to engage wedge coupling surfaces on the second body, the wedge coupling surfaces on the quick coupler forming an angle of between 60 and 44 degrees measured between a line passing through the center of the tube and through the wedge coupling surface, and a line parallel to the wedge coupling surface.

An implement comprises at least two hooks, at least two wedge pockets, and a wedge coupling surface forming an angle of between 60 and 44 degrees measured between a line passing through the center of the hooks and through the wedge coupling surface, and a line parallel to the wedge coupling surface.

DETAILED DESCRIPTION

FIGS. 1-12 illustrate embodiments of a quick coupler, and several embodiments of tools that may be attached to the quick coupler. The purpose of these figures and the related descriptions is merely to aid in explaining the principles of the invention. Thus, the figures and descriptions should not be considered as limiting the scope of the invention to the embodiment shown herein. Other embodiments of quick couplers and tools may be created which follow the principles of the invention as taught herein, and these other embodiments are intended to be included within the scope of patent protection.

One important feature of a quick coupler is the ability to hold the implement tightly in a variety of conditions. Ideally, there should be no or very little movement between the implement and the quick coupler—they should be firmly mounted to one another in a tight fit. Ideally, the quick coupler should also be capable of compensating for wear on mating surfaces, so that a tight fit can be maintained throughout the coupler's life. Movement between mating surfaces of the implement and the coupler can cause premature wear. Excessive movement can also affect the controllability of the implement. The implement may be difficult to precisely position if there is uncontrolled movement between the implement and the coupler.

Another important feature of a quick coupler is visibility. The quick coupler should allow a line of sight from the machine's cab, through the quick coupler, and to various areas of implements that may be mounted to the coupler. For example, when pallet forks are attached to the quick coupler, the operator should ideally be able to view the ends of the forks so they can be precisely positioned in a pallet.

Another important feature of a quick coupler is its effect on the kinematics of the implement. An implement's performance may depend closely upon the way the machine can move the implement. For example, a wheel loader bucket's breakout force depends upon the force applied to the bucket by the wheel loaders tilt actuator, the distance between the bucket-tilt actuator link and the bucket-lift arm link, and the geometry of the bucket. If a quick coupler is interposed between the bucket and the machine, these kinematic factors may change, resulting in a degradation of the bucket's performance. Thus, ideally the quick coupler should minimize its effect on the kinematic performance of the implement.

Other important features of quick couplers include the ease of picking up or attaching various implements, cost, and reliability. The quick coupler must also be able to transfer the high forces on the implement to the machine. Fatigue failures can be a problem if stresses on the quick coupler are too high, and should be avoided by appropriate design and construction.

Figure 1:
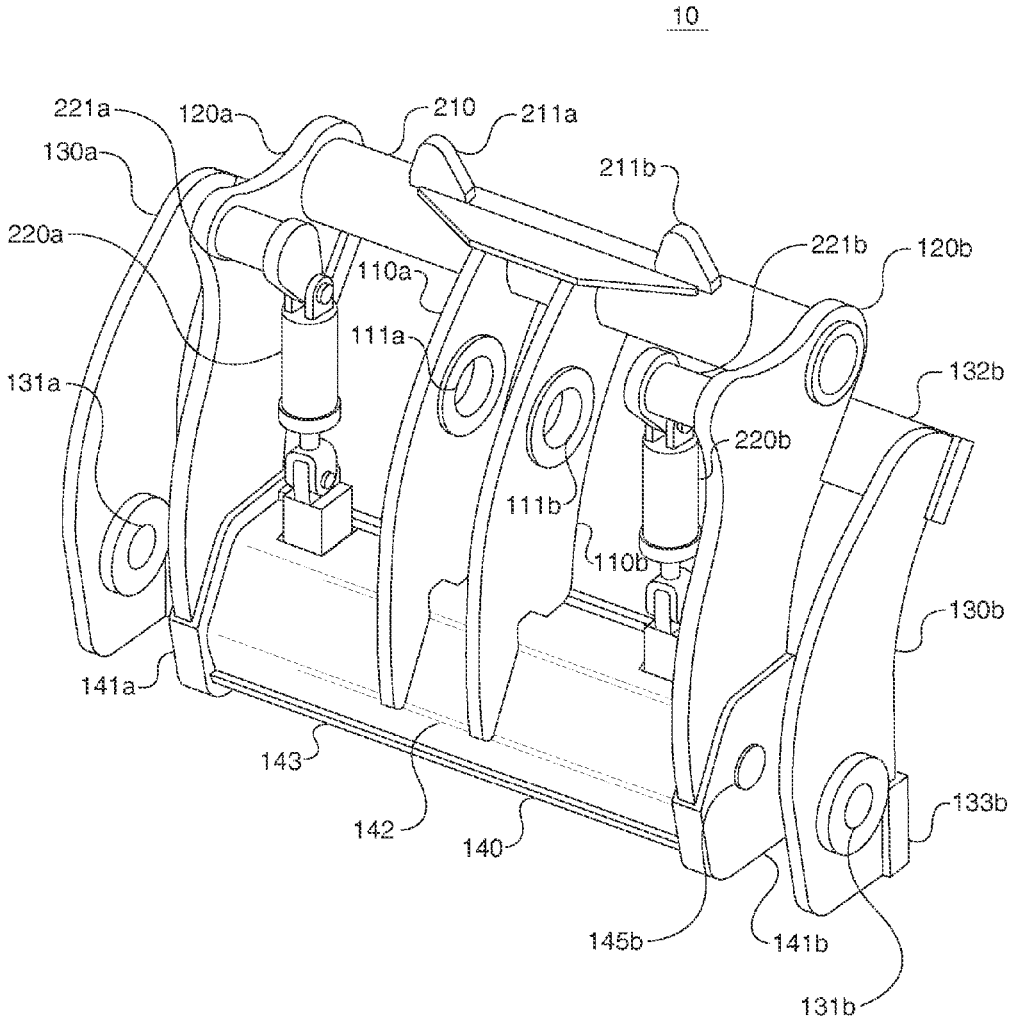
FIGS. 1 and 2 are views of the back and front, respectively, of an exemplary embodiment of a quick coupler.
Figure 2:
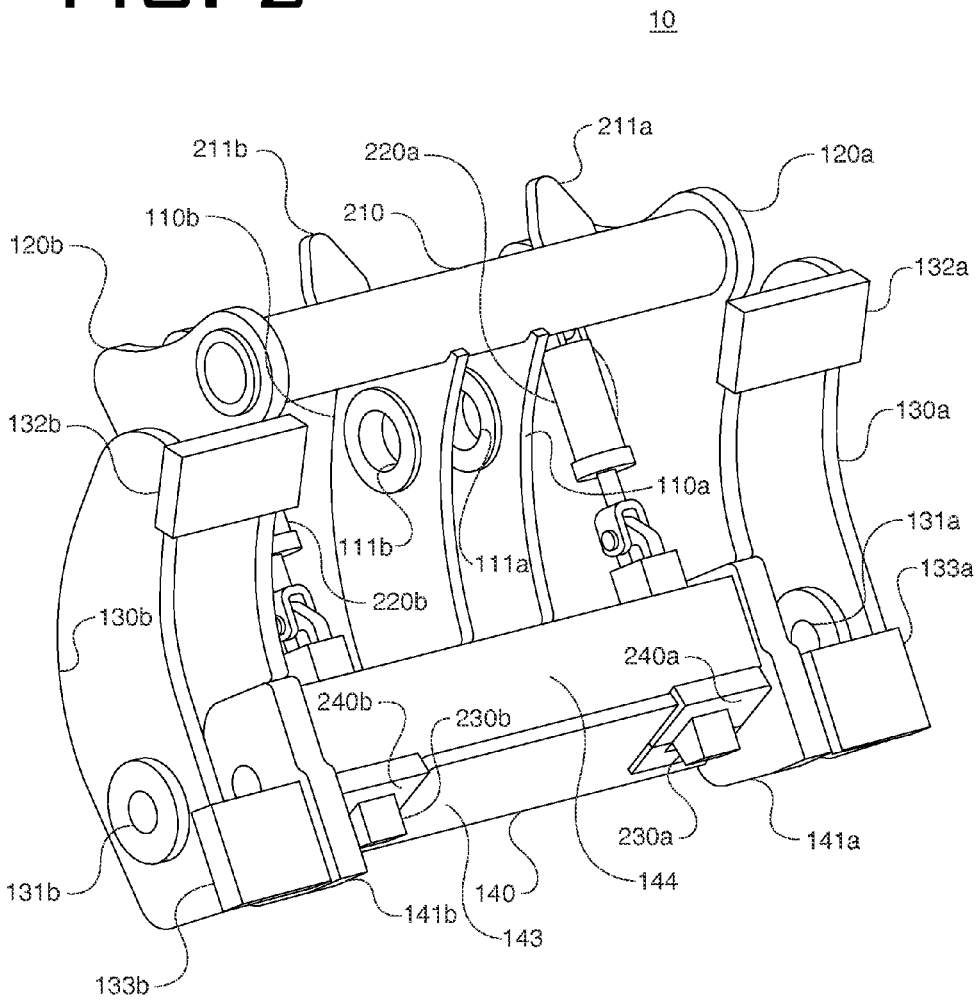

With reference first to FIGS. 1 and 2, a quick coupler 10 is illustrated. FIG. 1 shows a back view of the quick coupler 10. FIG. 2 shows a front view of the quick coupler 10. A frame 100 is the structural "backbone" of the quick coupler 10. The frame 100 serves to position attachment points for attaching the quick coupler 10 to the machine, and to position attachment points for attaching the quick coupler 10 to various implements. The frame 100 provides rigidity between those attachment points, and transfers forces between the machine and the implements. The frame 100 could take many forms. One advantageous form is depicted in the drawing figures. However, other forms could be used. For example, the quick coupler 10 would have a different frame 100 if it was desired to adapt the quick coupler for a different type of machine. The quick coupler illustrated herein is especially adapted for a wheel loader application. A similar quick coupler could be made for excavators or other machinery through applying the principles of the invention.

The frame 100 includes plate-shaped center members 110*a* and 110*b*. Throughout this description, like elements on opposite sides of a structure will be referred to by the same reference number, followed by the suffix "a" or "b." The frame 100 also includes plate-shaped middle members 120*a* and 120*b*, and plate-shaped end members 130*a* and 130*b*. Top extension plates 132*a* and 132*b*, and bottom extension plates 133*a* and 133*b* attach the end members 130*a* and 130*b* to the middle members 120*a* and 120*b*. Top extension plates 132*a* and 132*b* also act as rack stops for an implement. A box structure 140 extends between and ties together the center members 110*a* and 110*b* and the middle members 120*a* and 120*b*. The box structure includes box ends 141*a* and 141*b*, a top plate 142, a bottom plate 143, and a front plate 144.

Figure 3:
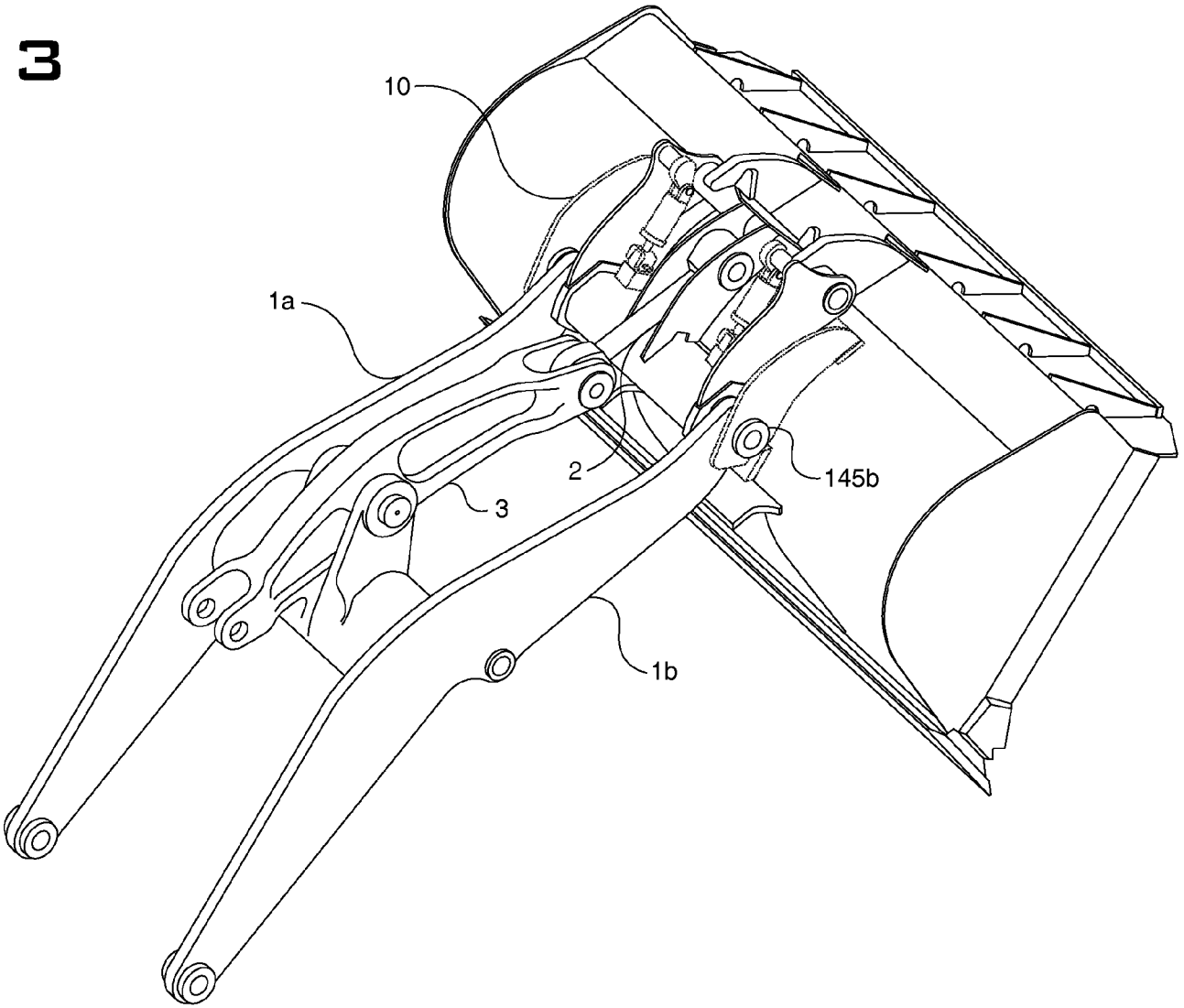
FIG. 3 illustrates the quick coupler of FIG. 1 mounted to the linkage of an exemplary machine.

The quick coupler 10 has attachment means including mounting structure for mounting to a machine. Lift arm bores 131*a*, 131*b*, 145*a*, and 145*b* are formed in the end members 130*a* and 103*b*, and the box ends 141*a* and 141*b*, respectively. The lift arm bores accept pins (not shown) for attaching the quick coupler 10 to the lift arms of a linkage of a machine. Likewise, tilt link bores 111*a* and 111*b* are formed in the center members 110*a* and 110*b* and accept a pin (not shown) for attaching the quick coupler 10 to the tilt link of a linkage of a machine. FIG. 3 illustrates how the coupler 10 attaches to a machine's lift arms 1*a* and 1*b* and tilt link 2. The pin joints permit relative rotation between the lift arms 1*a* and 1*b* and the quick coupler 10. Likewise, the pin joint at the tilt link 2 permits rotation of the quick coupler 10. The tilt link 2 may be attached to a tilt lever 3, as is known in this art, to cause quick coupler to tilt, or rack, backward and forward. The lift arms 1*a* and 1*b* rotate relative to the machine at their ends opposite the quick coupler 10 to raise and lower the coupler. In FIG. 3, it can be seen how top extension plates 132*a* and 132*b* will contact lift arms 1*a* and 1*b* and act as a rack stop if the quick coupler 10 is racked back all the way towards the lift arms.

Returning to FIGS. 1 and 2, the quick coupler 10 includes mounting structure for mounting an implement thereto. The mounting structure includes a tube 210 that extends between the middle members 120*a* and 120*b*, and is also attached to center members 110*a* and 110*b*. Hydraulic cylinders 220*a* and 220*b* are mounted at one end to the frame 100 by mounting posts 221*a* and 221*b*. At the other end of hydraulic cylinders 220*a* and 220*b* are mounted wedges 230*a* and 230*b*. The hydraulic cylinders 220*a* and 220*b* are configured to extend and retract wedges 230*a* and 230*b* under power of pressurized hydraulic fluid. The extension and retraction of the wedges 230*a* and 230*b* occurs during the mounting and dismounting of an implement to the quick coupler 10. Although hydraulic cylinders 220*a* and 220*b* are illustrated, other actuators could be used to move the wedges 230*a* and 230*b*, as will be understood by those of ordinary skill in the art. In addition, although two hydraulic cylinders 220*a* and 220*b* are illustrated, a single hydraulic cylinder with a linkage system could be used to extend and retract both wedges 230*a* and 230*b*.

The relative placement on the coupler 10 of the mounting structure for mounting the coupler to the machine, and the mounting structure for mounting the coupler to the implement, may minimize the impact on the kinematics between machine and implement.

Figure 4:
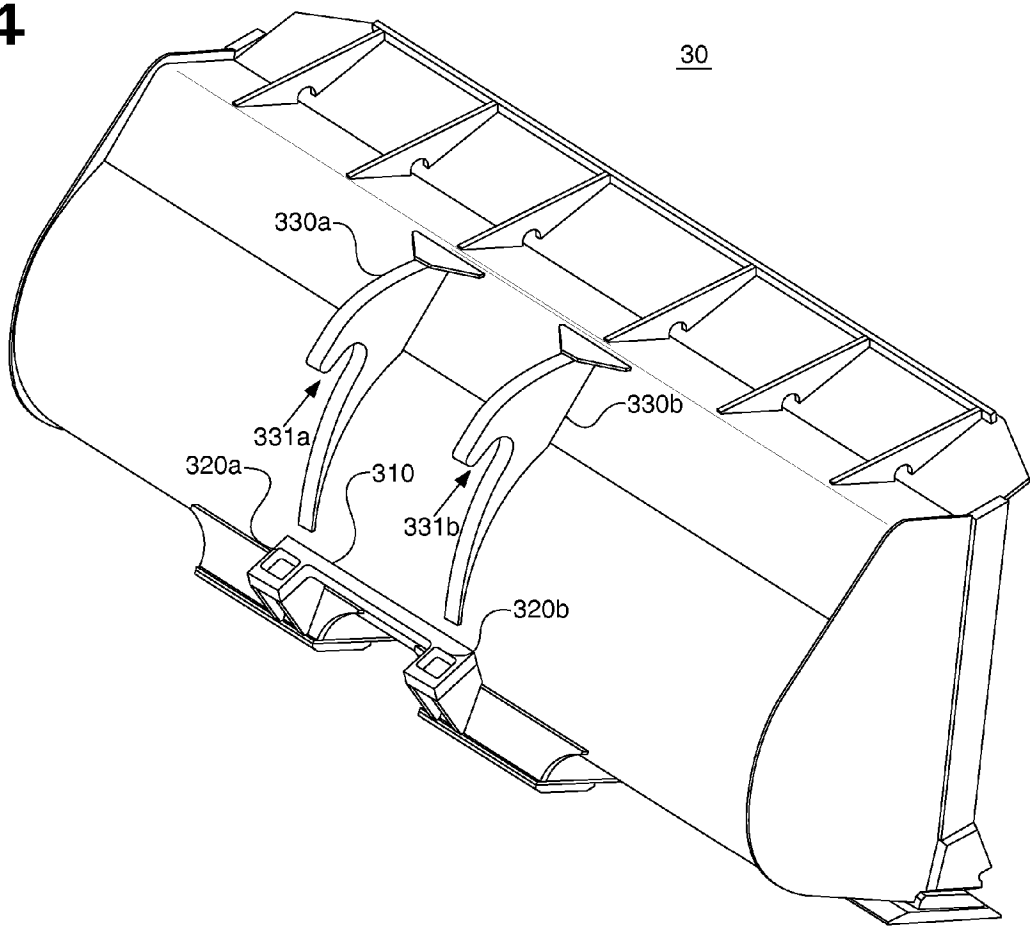
FIGS. 4 and 5 illustrate an exemplary embodiment of a tool, in this case a bucket, which can be attached to the quick coupler of FIG. 1.
Figure 5:
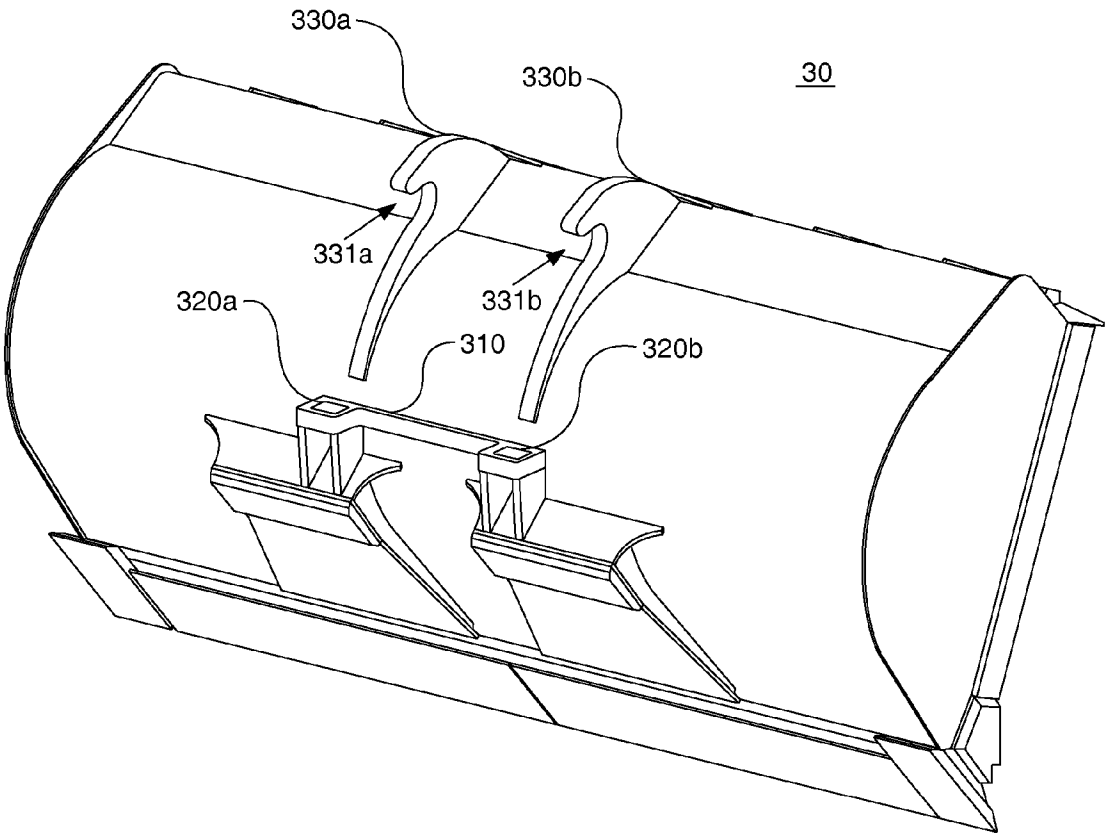

FIGS. 4 and 5 illustrate a type of implement, a bucket 30, that could be mounted to the quick coupler 10. Bucket 30 includes mounting structure to mount the bucket to the quick coupler 10. The mounting structure includes a wedge plate 310. Wedge plate 310 includes wedge pockets 320*a* and 320*b*. The mounting structure also includes hook plates 330*a* and 330*b*. Hook plates 330*a* and 330*b* define hooks 331*a* and 331*b*. Each of hooks 331*a* and 331*b* may be generally circularly defined with a center point along a central axis. As shown in the figures herein, the central axes of the hooks 331*a* and 331*b* may be coaxial. Each of the Hooks 331*a* and 331*b* are configured to mount to the top tube 210 of quick coupler 10. Wedge pockets 320*a* and 320*b* are configured to accept wedges 230*a* and 230*b*, as will be described in more detail hereinafter. The wedge pockets 320*a* and 320*b* may be advantageously formed as rectangularly-shaped cut through holes in the wedge plate 310, with sides that are parallel to one another and perpendicular to the top of wedge plate 310. This reduces the manufacturing cost and complexity.

Figure 6:
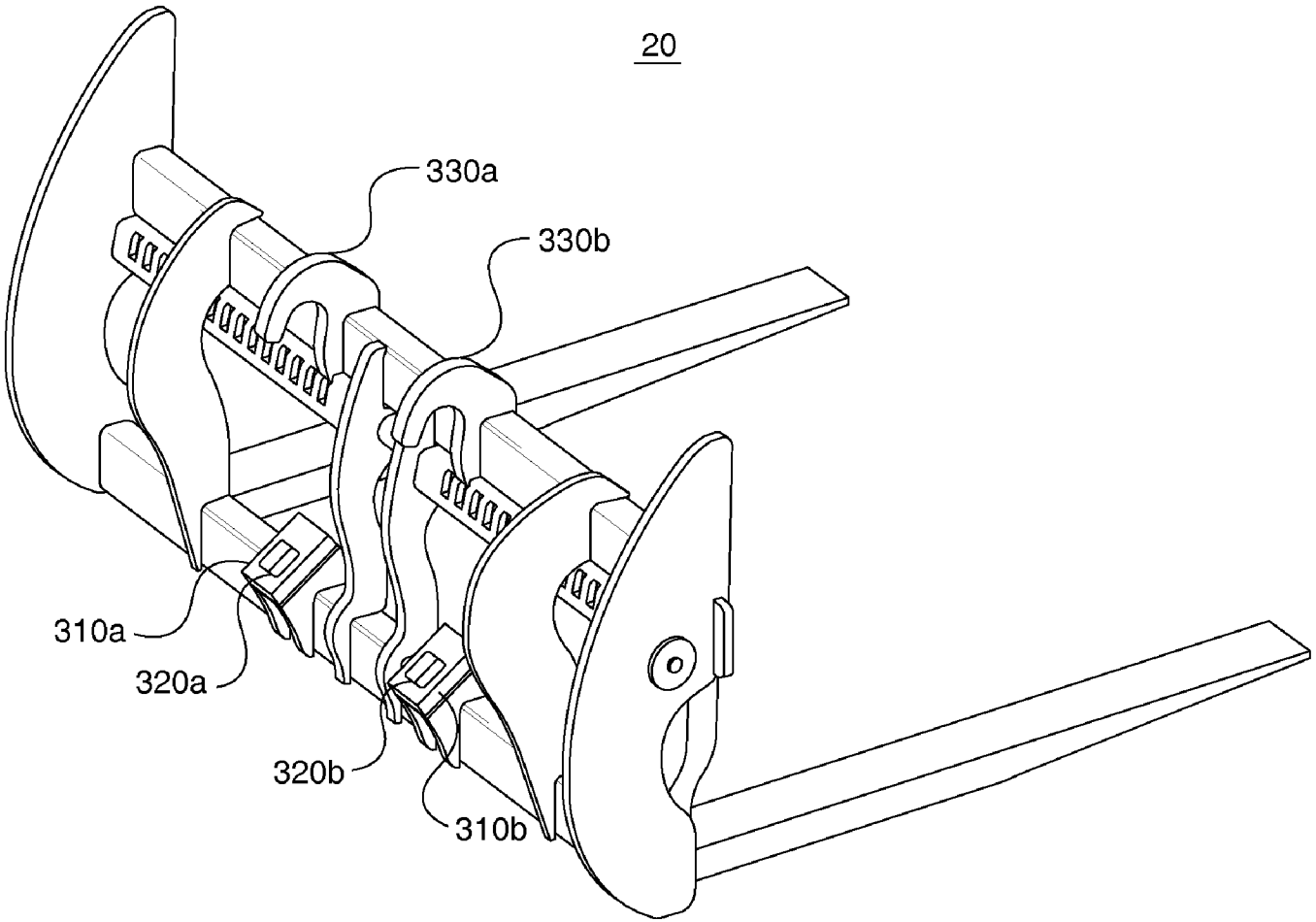
FIG. 6 illustrates another exemplary embodiment of a tool, a pallet fork, which can be attached to the quick coupler of FIG. 1.

FIG. 6 illustrates another type of implement that could be mounted to the quick coupler 10, a pallet fork 20. Pallet fork 20 may include the same mounting structure for mounting to quick coupler 10 as bucket 30. However, instead of a single wedge plate 310, pallet fork 20 has two wedge plates 310*a* and 310*b*. Wedge pockets 320*a* and 320*b* are formed in the wedge plates 310*a* and 310*b*, respectively.

Figure 7:
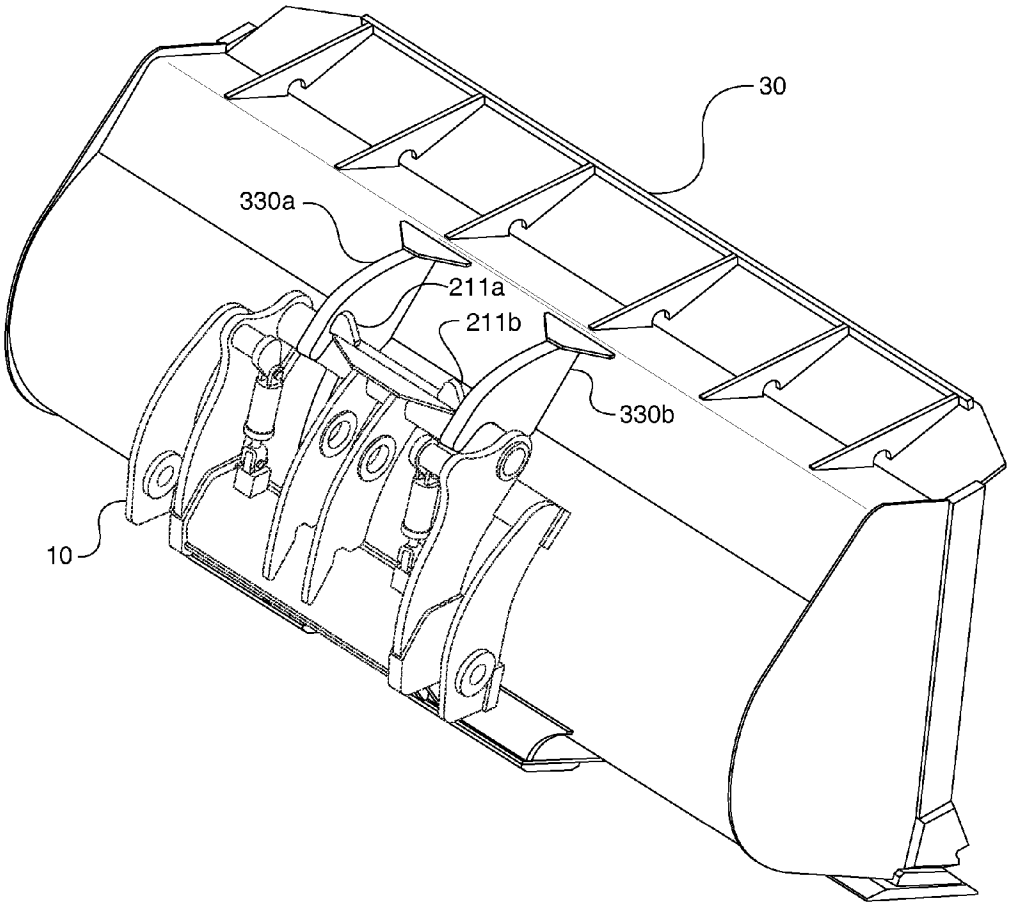
FIG. 7 is view of the quick coupler of FIG. 1 attached to the bucket of FIG. 4.

FIG. 7 illustrates the quick coupler 10 mounted to the bucket 30. The tube 210 is first positioned in hooks 331*a* and 331*b*. The machine operator then lifts the lift arms 1*a* and 1*b*, lifting the quick coupler 10 and the bucket 30. If necessary, the operator can then rack back the quick coupler 10 until the wedges 230*a* and 230*b* are positioned over the wedge pockets 320*a* and 320*b*. The operator can then command, from inside the cab via an auxiliary hydraulic circuit, the hydraulic cylinders 220*a* and 220*b* to extend. The cylinders drive the wedges 230*a* and 230*b* into the wedge pockets 320*a* and 320*b* to complete the coupling procedure. The bucket 30 can be released from the quick coupler 10 through reversing the same procedure.

The top tube 210 includes ears 211*a* and 211*b*. When the quick coupler is mounted to an implement, the ears 211*a* and 211*b* abut the hook plates 330*a* and 330*b*. This helps prevent the bucket 30 from twisting relative to the quick coupler 10 and helps prevent relative movement.

Figure 8:
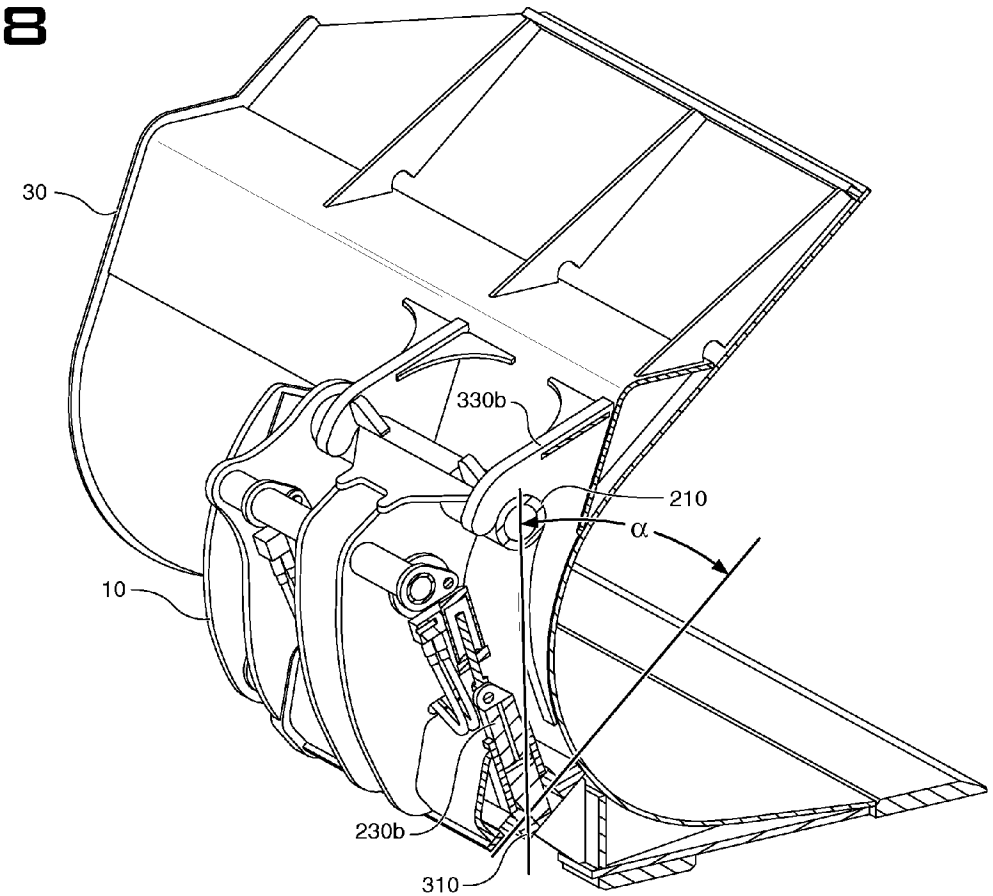
FIG. 8 is a sectioned solid view of a quick coupler and bucket.
Figure 9:
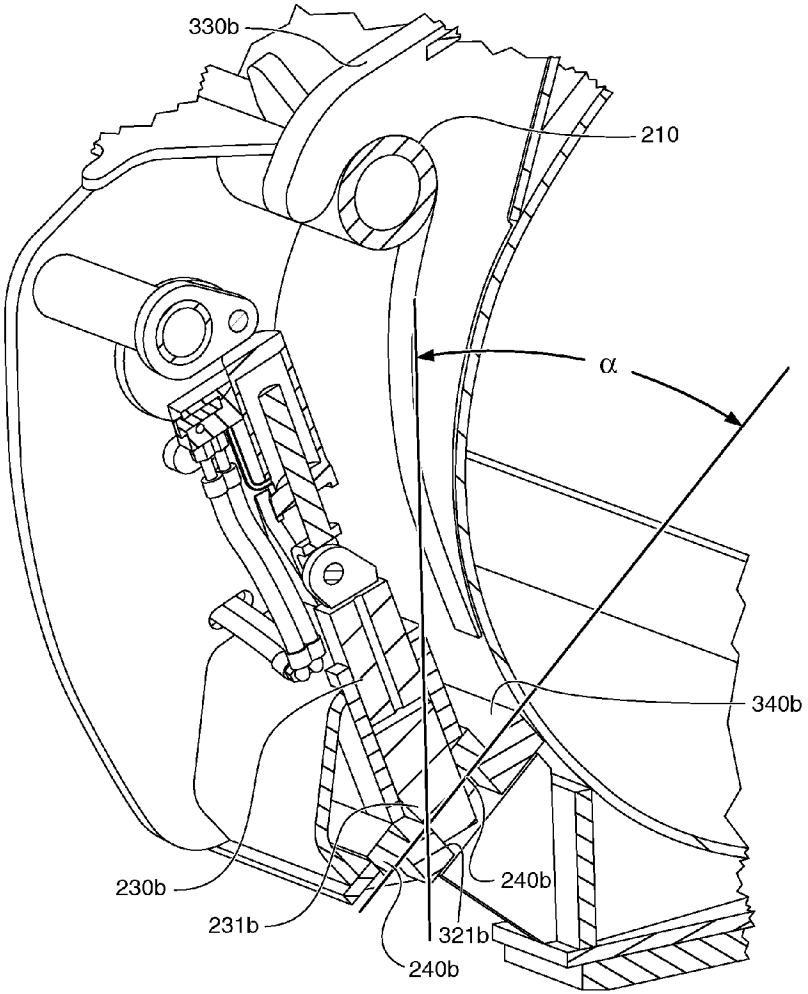
FIG. 9 is a detail view taken from FIG. 8.

FIG. 8 is a solid sectioned view of the bucket 30 and quick coupler 10. This sectioned view is taken through the central axis of hydraulic cylinder 220*b*, and parallel to the mid-plane of middle member 120*b*. FIG. 9 is a detail view taken from FIG. 8. FIG. 8 shows the wedge 230*b* retracted from the wedge pocket 320*b* so that quick coupler 10 can be detached from bucket 30. Wedge 230*b* extends out from the frame 100 through a wedge coupling surface 240*b* which at least partially surrounds wedge 230*b*. Likewise, wedge 230*a* extends out from a wedge coupling surface 240*a* which at least partially surrounds wedge 230*a*. The bucket 30 also has wedge coupling surfaces 340*a* and 340*b* formed on wedge plate 310, which each at least partially surround the wedge pockets 320*a* and 320*b*, respectively. The surfaces 240*a*, 240*b*, 340*a*, and 340*b* are at least approximately parallel when the quick coupler 10 engages the bucket 30.

The wedges 230*a*, 230*b* include a camming surface 231*a*, 231*b*. When the quick coupler 10 and the bucket 30 are engaged, the camming surfaces 231*a* and 231*b* are approximately parallel to the side walls of wedge pockets 320*a* and 320*b* of bucket 30. When the wedges 230*a* and 230*b* are extended, the camming surfaces 231*a* and 231*b* engage and cam, or wedge, against the rear side walls 321*a* and 321*b* of pockets 320*a* and 320*b*. Downward force on the wedges 230*a* and 230*b* at this moment converts into a force pushing wedge coupling surfaces 240*a* and 240*b* toward bucket 30, and into tighter engagement with wedge coupling surfaces 340*a* and 340*b*. The wedging action between the wedge coupling surfaces holds the coupler 10 tighter against the bucket 30. When the wedging action occurs, the quick coupler is rotating slightly relative to the bucket 30 around the center of the hooks 331*a* and 331*b* and the top tube 210.

The wedge coupling surfaces 240*a* and 240*b* on the coupler wedge against the wedge coupling surfaces 340*a* and 340*b* on the bucket, as explained above. These surfaces form an angle $\alpha$ relative to a line passing through the center of the hooks 331*a* and 331*b* and the top tube 210 and through the surfaces themselves. The angle $\alpha$ is important for achieving the right balance of wedging action and the proper functioning of the coupler 10. If the angle $\alpha$ is too close to 90 degrees, then the surfaces 240*a,b* and 340 can wedge together too tightly, making it difficult to disengage the bucket 30 from the quick coupler 10. If the angle $\alpha$ is too close to 0 degrees, there will not be adequate wedging action to force the surface tightly together and create a tight fit. An angle $\alpha$ of approximately 60-44 degrees has been found to be an ideal balance, creating adequate wedging action to hold the wedging surfaces together tightly, but not too tightly. Even better is an angle $\alpha$ in the range of 56-48 degrees, and even better would be an angle $\alpha$ of approximately 52 degrees.

Figure 10:
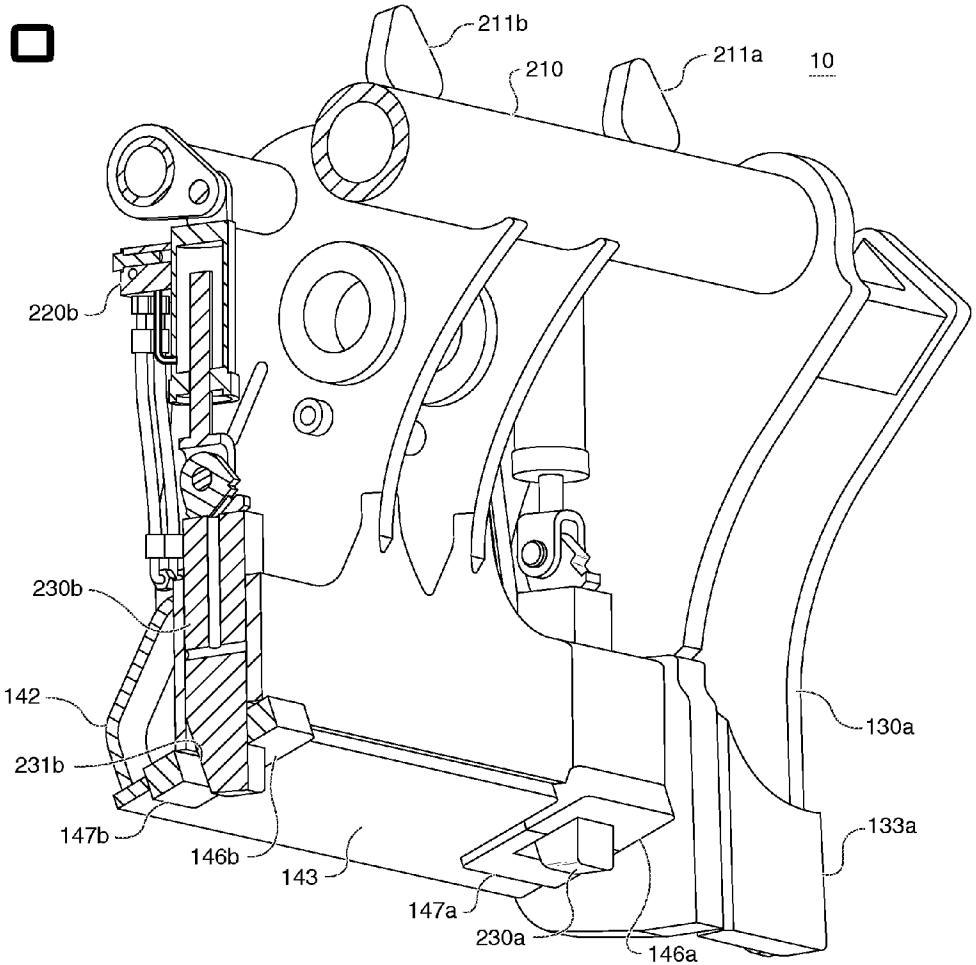
FIG. 10 is a sectioned solid view of the quick coupler of FIG. 8.

With reference now to FIG. 10, attached to the bottom plate 143, and forming at least part of the opening for the wedge 230*b*, are two horseshoe plates 146*b* and 147*b*. Likewise, horse shoe plates 146*a* and 146*b* form at least part of the opening for wedge 230*a*. These horseshoe plates are especially adapted to transfer the loads from the wedges 230*a* and 230*b* to the box structure 140.

Figure 11:
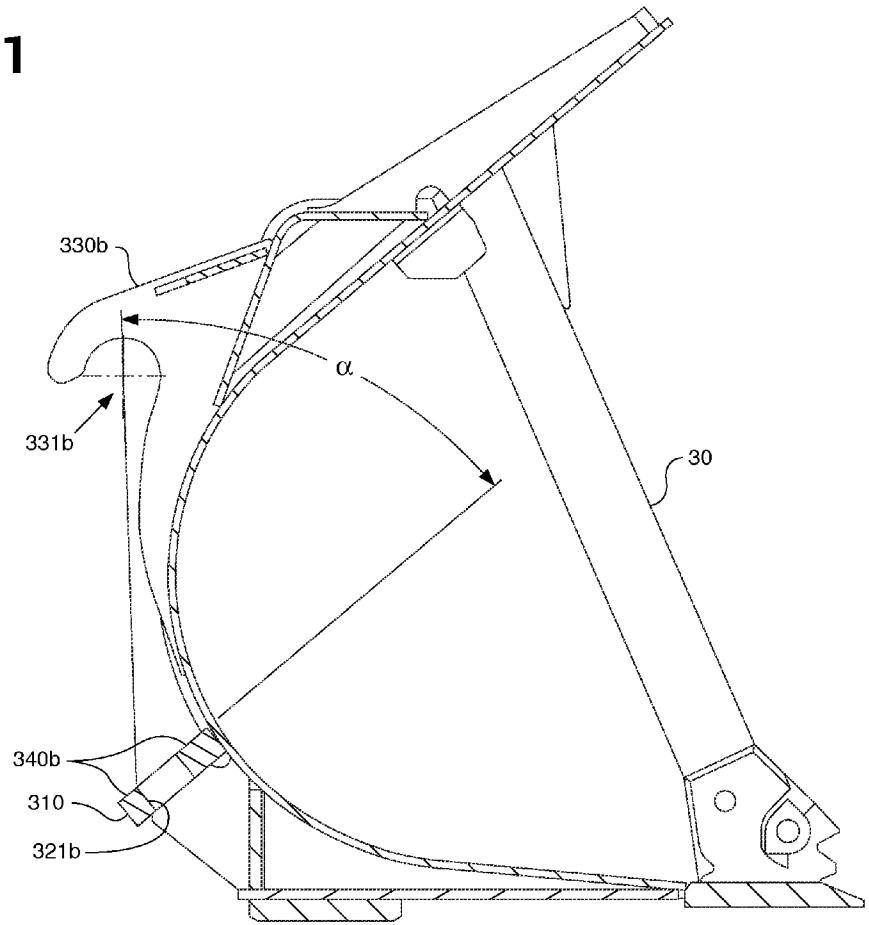
FIG. 11 is sectional view of the bucket of FIG. 8.

FIG. 11 is a sectional view of the bucket 30 alone which more clearly shows the measurement of the angle $\alpha$. The angle $\alpha$ is measured between a line passing through the center of hook 331*b* and through the intersection of the rear side wall 321*b* and the wedge coupling surface 340*b*, and a line parallel to the wedge coupling surface 340*b*.

The only contact between the bucket 30 and the quick coupler 10 occurs between the top tube 210 and the hook plates 330*a* and 330*b*, between the wedge coupling surfaces 240*a*, 240*b*, 340*a*, and 340*b*, and between the wedges 230*a* and 230*b* and the pockets 320*a* and 320*b*. The forces from the bucket 30 to the quick coupler 10 are generally transferred between the top tube and hook plates, and between the wedge coupling surfaces. If any of these surfaces should wear during use, the wedging action of the coupler 10 to the bucket 30 will take up the extra play and keep the two tightly engaged. This is facilitated by the stroke of hydraulic cylinders 220*a* and 220*b* being selected such that the cylinders are capable of extending farther than the position where the wedges 230*a* and 230*b* would normally come to rest against the rear side walls 321*a* and 321*b* of the wedge pockets 320*a* and 320*b*. This is also facilitated by ample space between the surfaces of the coupler 10 and bucket 30 so those other surfaces do not interfere even after significant wear of the wedge coupling surfaces. The wedge coupling surfaces 240*a* and 240*b* of coupler 10 should be allowed to swing at least 5 mm closer to the bucket 30 to account for future possible wear, and ideally 15 mm, and even more ideally 30 mm.

Figure 12:
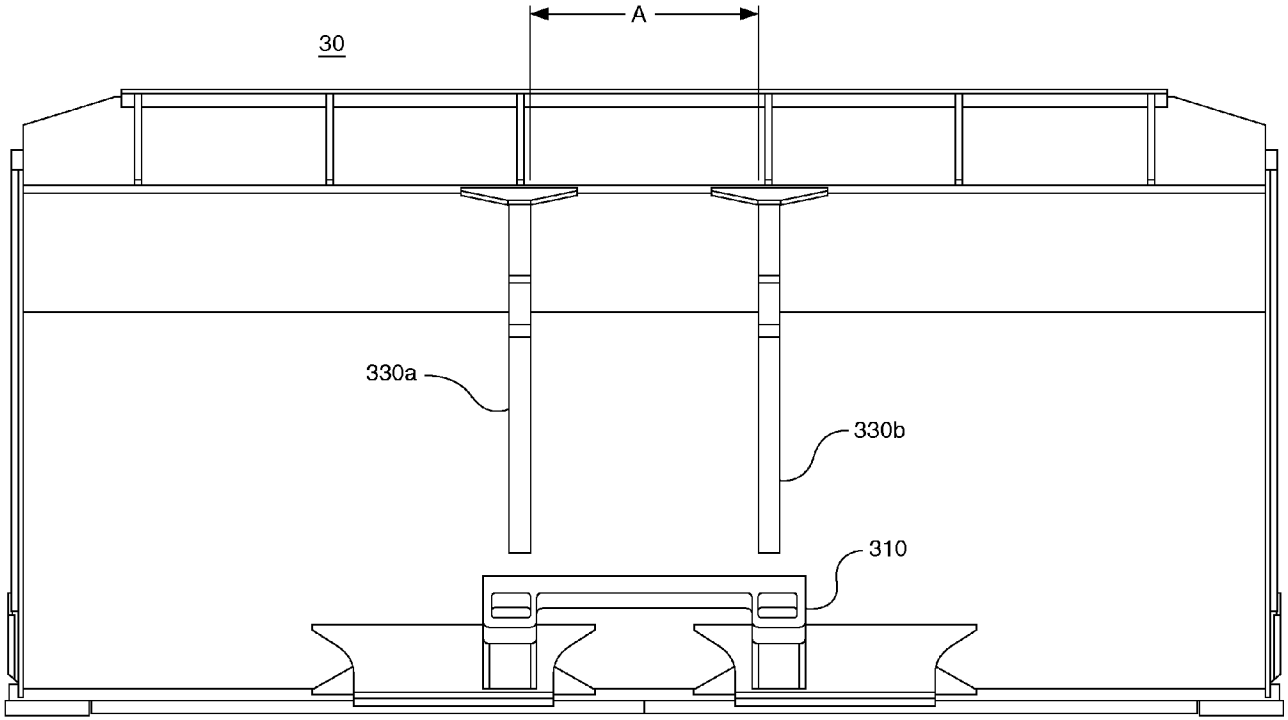
FIG. 12 is a rear view of a bucket.

FIG. 12 shows a rear view of the bucket 30. The hook plate 330*a* is generally in the same vertical plane on the bucket 30 as wedge pocket 320*a*. The vertical plane can be defined as a plane parallel to a mid plane of the hook plate 330*a* or 330*b*. Likewise, hook plate 330*b* is generally in the same vertical plane on the bucket 30 as wedge pocket 320*b*. The distance A between hook plates 330*a* and 330*b* controls the relative placement of hydraulic cylinders 220*a* and 220*b* on coupler 10 because the cylinders must be approximately in line with wedge pockets 320*a* and 320*b*. As discussed previously, visibility is an important concern in designing a quick coupler. Ideally, the operator should have lines of sight through the coupler to important areas on the implement. The placement of the hydraulic cylinders 220*a* and 220*b*, which also effects the placement of members within frame 100, has a large impact on visibility. It has been determined that an optimum distance A between hook plates 330*a* and 330*b* for permitting visibility to the important areas on an implement is within the range of 580 mm to 500 mm. More ideally, the distance A is between 560 mm to 520 mm, and most ideally the distance A is approximately 540 mm. This distance A has been also been determined based upon the desire to adapt the coupler 10 to be usable with many different styles of linkages of machines, and also to allow for the adequate strength of all the members of coupler 10 and bucket 30.

We claim:

1. An implement comprising:

a first hook plate defining a first hook with a center axis;

a first wedge plate having a flat first wedge coupling surface formed thereon;

a first wedge pocket located in approximately the same vertical plane as the first hook plate, the first wedge pocket defined by a rectangularly-shaped opening formed through the first wedge plate and through the first wedge coupling surface, the first wedge coupling surface at least partially surrounds the first wedge pocket;

a second hook plate defining a second hook with a center axis, the center axis of the first hook and the center axis of the second hook are coaxial;

a second wedge plate having a flat second wedge coupling surface formed thereon, the first wedge coupling surface and the second wedge coupling surface are coplanar;

a second wedge pocket located in approximately the same vertical plane as the second hook plate, the second wedge pocket defined by a rectangularly-shaped opening formed through the second wedge plate and through the second wedge coupling surface, the second wedge coupling surface at least partially surrounds the second wedge pocket;

wherein the first wedge coupling surface forms an angle $\alpha$ measured between a line passing through the center axis of the first hook and through the first wedge coupling surface, and a line parallel to the first wedge coupling surface;

wherein the second wedge coupling surface forms an angle $\alpha$ measured between a line passing through the center of the second hook and through the second wedge coupling surface, and a line parallel to the second wedge coupling surface; and the angle $\alpha$ is between 60 and 44 degrees.

2. An implement according to claim 1 wherein the angle $\alpha$ is between 56 and 48 degrees.

3. An implement according to claim 1 wherein the angle $\alpha$ is approximately 52 degrees.

4. An implement according to claim 3 wherein the space between the first hook plate and the second hook plate is between 580 to 500 mm.

5. An implement according to claim 1 wherein the first wedge pocket is defined by an opening having four sides, and each of the four sides is normal to the first wedge coupling surface, and the second wedge pocket is defined by an opening having four sides, and each of the four sides is normal to the second wedge coupling surface.

6. An implement comprising:

at least two hooks;

a wedge plate having a flat wedge coupling surface;

at least two wedge pockets each comprising a rectangularly-shaped opening formed through the wedge plate and through the wedge coupling surface; and the wedge coupling surface forming an angle of between 60 and 44 degrees measured between a line passing through the center of the hooks and through the wedge coupling surface, and a line parallel to the wedge coupling surface.

7. An implement according to claim 6 wherein the angle is between 56 and 48 degrees.

8. An implement according to claim 6 wherein the angle is approximately 52 degrees.

9. An implement according to claim 6 wherein each of the at least two hooks is located in approximately the same vertical plane as one of the at least two wedge pockets.

10. An implement according to claim 6 wherein the space between the hooks is between 580 to 500 mm.

11. An implement according to claim 6 wherein the at least two hooks each include a generally circular interface with a center point along a central axis.

12. An implement according to claim 11 wherein the center axes the at least two hooks are coaxial.

13. An implement according to claim 6 wherein the flat wedge coupling surface entirely surrounds each of the at least two wedge pockets.

14. An implement comprising:

a first hook plate defining a first hook with a center axis;

a wedge plate having a flat wedge coupling surface formed thereon;

a first wedge pocket located in approximately the same vertical plane as the first hook plate, the first wedge pocket defined by a rectangularly-shaped opening formed through the wedge plate and through the wedge coupling surface, the wedge coupling surface at least partially surrounds the first wedge pocket;

a second hook plate defining a second hook with a center axis, the center axis of the first hook and the center axis of the second hook are coaxial;

a second wedge pocket located in approximately the same vertical plane as the second hook plate, the second wedge pocket defined by a rectangularly-shaped opening formed through the wedge plate and through the wedge coupling surface, the wedge coupling surface at least partially surrounds the second wedge pocket;

wherein the wedge coupling surface forms an angle $\alpha$ measured between a line passing through the center axis of the first hook and through the wedge coupling surface, and a line parallel to the wedge coupling surface; and the angle $\alpha$ is between 60 and 44 degrees.

15. An implement according to claim 14 wherein the angle $\alpha$ is between 56 and 48 degrees.

16. An implement according to claim 14 wherein the angle $\alpha$ is approximately 52 degrees.

17. An implement according to claim 16 wherein the space between the first hook plate and the second hook plate is between 580 to 500 mm.

18. An implement according to claim 14 wherein the first wedge pocket is defined by an opening having four sides, and each of the four sides is normal to the first wedge coupling surface, and the second wedge pocket is defined by an opening having four sides, and each of the four sides is normal to the second wedge coupling surface.

19. An implement for coupling to a wheel loader via a coupler comprising:

at least two hooks defining coaxial central axes;

a flat wedge coupling surface; and at least two wedge pockets formed in the wedge coupling surface, the wedge coupling surface entirely surrounding each wedge pocket, each wedge pocket including four sides forming a rectangular opening with each of the sides normal to the wedge coupling surface.

20. An implement for coupling to a wheel loader via a coupler according to claim 19 wherein the wedge coupling surface forms an angle of between 60 and 44 degrees measured between a line passing through the center of the hooks and through the wedge coupling surface, and a line parallel to the wedge coupling surface.

21. An implement for coupling to a wheel loader via a coupler according to claim 19 wherein the angle is between 56 and 48 degrees.

22. An implement for coupling to a wheel loader via a coupler according to claim 19 wherein the angle is approximately 52 degrees.

23. An implement for coupling to a wheel loader via a coupler according to claim 22 wherein the space between the hooks is between 580 to 500 mm.

* * * * *